United States Patent [19]

Gertsch et al.

[11] 4,040,348

[45] Aug. 9, 1977

[54] DUCTOR OR FILM-TRANSFERRING INKING MECHANISM, PARTICULARLY FOR OFFSET PRESSES

[75] Inventors: Peter Gertsch, Bern; Alfons Wehrli, Liebefeld, both of Switzerland

[73] Assignee: Maschinenfabrik Wifag, Switzerland

[21] Appl. No.: 675,061

[22] Filed: Apr. 8, 1976

[30] Foreign Application Priority Data

May 5, 1975 Switzerland ..... 5713/75

[51] Int. Cl.[2] ..... B41L 27/16; B41L 27/22

[52] U.S. Cl. ..... 101/350; 101/425; 101/148

[58] Field of Search ..... 101/349, 350, 351, 352, 101/363, 364, 148, 425

[56] References Cited

U.S. PATENT DOCUMENTS

| | | | |
|---|---|---|---|
| 1,058,040 | 4/1913 | Crump | 101/425 |
| 1,576,598 | 3/1926 | Goulding | 101/425 |
| 2,847,935 | 8/1958 | Richter | 101/425 |
| 3,926,114 | 12/1975 | Matuschke | 101/350 |

FOREIGN PATENT DOCUMENTS

| | | | |
|---|---|---|---|
| 959,369 | 3/1957 | Germany | 101/425 |
| 660,489 | 10/1936 | Germany | 101/350 |
| 353,751 | 6/1961 | Switzerland | 101/350 |

*Primary Examiner*—J. Reed Fisher

*Attorney, Agent, or Firm*—McGlew and Tuttle

[57] ABSTRACT

A ductor or film-transferring inking mechanism for printing machine, particularly for offset presses, which comprise a plate cylinder having a printing form, an ink reservoir and a ductor roller mounted for rotation so as to dip into the ink reservoir and at least one additional rotatable distributor roller engageable between the ductor roller and the plate cylinder. A rotatable takeoff roller is associated with one of the distributor rollers of the inking mechanism and is adapted to engage with one of these rollers and take up the periodically unused and no longer applicable ink from this roller and to be moved to a position so as to be engageable with a stripper roller so as to transfer this ink to the stripping roller. A stripper such as a ductor blade is engaged with the surface of the stripper roller and it strips the ink therefrom and permits it to return into either a separate container or directly back into the ink reservoir.

2 Claims, 2 Drawing Figures

DUCTOR OR FILM-TRANSFERRING INKING MECHANISM, PARTICULARLY FOR OFFSET PRESSES

FIELD AND BACKGROUND OF THE INVENTION

This invention relates in general to the construction of printing presses and in particular to a new and useful device for removing ink from the rollers of the inking mechanism, when the particular ink on the rollers is no longer being used.

DESCRIPTION OF THE PRIOR ART

The present invention deals particularly to a ductor or film-transferring inking mechanism for printing machines, particularly for offset presses. Ductor or film-transferring inking mechanism are well known for a long time. In such mechanism the printing ink is taken from the ink fountain by means of a fountain roller and is transferred by a ductor or film roller to a transfer roller where the ink film is supplied through a plurality of distributing and spreading rollers to the form rollers by which it is deposited on the printing form. Because of the manner of operation of said inking mechanisms, if the specific consumption of ink, for example for an individual small subject of design is small, most of the ink remains on the transfer rollers and consequently becomes gradually emulsified to a high degree by dampening water, and this may lead to a change of the color tint of the printed image as well as to a toning. Upon such an occurrence the rollers have to be cleaned and it may even become necessary to stop the press.

SUMMARY OF THE INVENTION

The present invention provides a ductor or film-transferring inking mechanism for printing machines, particularly offset presses, in which the unused, no longer applicable ink is automatically carried away. For this purpose in accordance with the invention, a takeoff roller is associated with one of the rollers of the inking mechanism and it is adapted to take up the periodically unused, no longer applicable ink from this roller and to transfer it to a stripping roller. The ink is then stripped from the stripping roller by a stripper such as a doctor blade and delivered to a container or back to the ink reservoir.

Accordingly it is an object of the invention to provide an apparatus for stripping ink from the rollers of an inking mechanism for inking a printing form, for example on a plate cylinder, which includes a takeup roller which is adapted to move into association with one of the distributing rollers between a ductor roller which picks up the ink and the plate cylinder, which receives the ink, so as to remove the ink from this roller, and it is then movable into association with a stripping roller which receives the ink and which is engaged by a stripper such as a doctor blade to remove it from the stripper and return it to a container or directly to the ink reservoir.

A further object of the invention is to provide an apparatus for removing ink from the distributing rollers of an ink mechanism which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
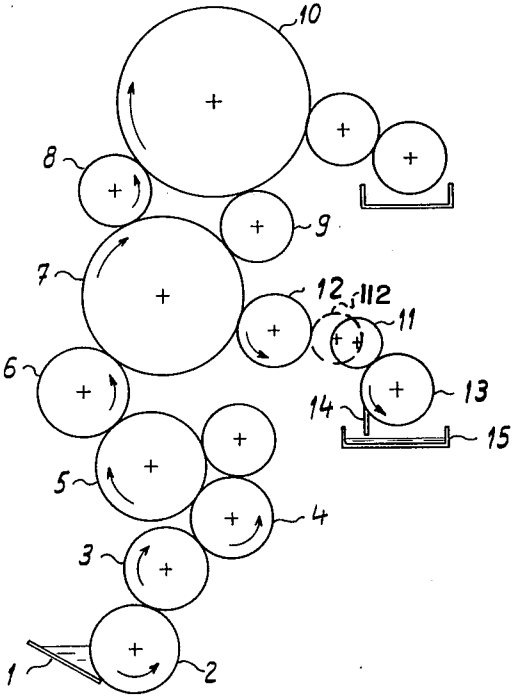
FIG. 1 is a diagrammatic illustration of a film-transferring inking mechanism in which the ink is returned from one of the transfer rollers of the inking mechanism to a separate container.

Referring to the drawings in particular, the invention embodied therein comprises, in FIG. 1, an ink fountain or reservoir 1 which contains printing ink which is to be drawn off by a ductor roller 2 which has a portion of its surface rotatable in a reservoir ink. A film roller 3 transfers the ink from the ductor roller 2 to a blanket roller 4 wherefrom the ink is delivered, through a plurality of distributing rollers 5, 6 and 7 to form rollers 8 and 9 by which it is deposited on the printing form carried by a plate cylinder 10. As shown in the embodiment of FIG. 1, a takeoff roller 11 is associated with a distributing roller 12 of the inking mechanism, and mounted for rotation and for oscillation between the solid line position shown and the dotted line position 11a. The roller 11 is periodically moved from the dotted line position 11a in which it removes ink from the distributing roller 12 to a solid line position 11 where it engages it with a stripping roller 13 which takes up the ink from the takeoff roller 11. The ink is then stripped from the stripping roller 13 by a stripper such as a doctor blade 14 and delivered to a container 15. The oscillatory movement of the roller is carried out, for example, by mounting the roller shaft on a swinging arm or other oscillating mechanism which is of known construction.

Figure 2:
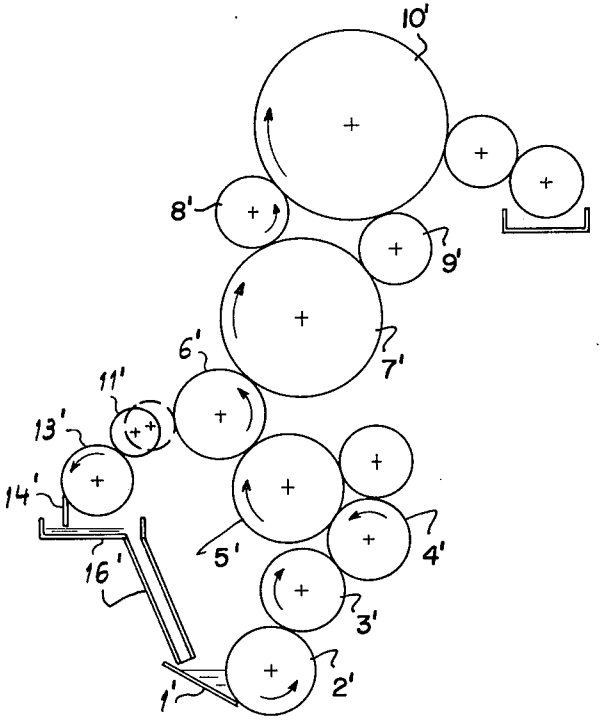
FIG. 2 is a view similar to FIG. 1 wherein the ink is returned directly to the ink reservoir.

In the embodiment of FIG. 2 similar parts are shown with similar numbers but with a prime added. In this embodiment the ink stripped from the roller 13' by a doctor blade 14' flows into ink collecting means such as the container 15 or, in this case, into a collecting reservoir 16 which connects downwardly through a channel 16' to a reservoir 1'.

While specific embodiments of the invention have been shown and described in detail to illustrate the application of the principles of the invention, it will be understood that the invention may be embodied otherwise without departing from such principles.

What is claimed is:

1. In a ductor or film-transferring inking mechanism for printing machines which include a plate cylinder having a printing form, an ink reservoir, a ductor roller mounted for rotation so as to dip into the ink of said ink reservoir, and at least one additional rotatable roller engageable during printing between the surfaces of said ductor roller and said plate cylinder, the improvement comprising a rotatable stripper roller, a stripper engaged with the surface of said stripper roller to strip ink therefrom as said stripper roller is rotated, ink return means located in a position to receive the stripped ink from said stripper roller, a rotatable take-off roller associated with one of said additional rollers of the inking mechanism and adapted to engage said one of said additional rollers to take up the periodically unused, no longer applicable ink from said additional roller and is also engageable with said stripper roller to transfer the ink to the stripping roller, and means mounting said takeoff roller for oscillating movement toward and away from said distributor roller and said stripping roller.

2. In a ductor or film-transferring inking mechanism according to claim 1 wherein said ink return means includes means for delivering the ink stripped from said stripping roller to said ink reservoir.

* * * * *